US007429174B2

(12) United States Patent
Burns et al.

(10) Patent No.: US 7,429,174 B2
(45) Date of Patent: Sep. 30, 2008

(54) CLEAN ATMOSPHERE HEAT TREAT FOR COATED TURBINE COMPONENTS

(75) Inventors: Steven M. Burns, West Hartford, CT (US); Steven P. Hahn, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 235 days.

(21) Appl. No.: 11/296,980

(22) Filed: Dec. 7, 2005

(65) Prior Publication Data

US 2006/0086439 A1 Apr. 27, 2006

Related U.S. Application Data

(62) Division of application No. 10/606,436, filed on Jun. 25, 2003.

(51) Int. Cl.
*F27B 5/16* (2006.01)

(52) U.S. Cl. ..... 432/200; 432/159

(58) Field of Classification Search ..... 432/152, 432/200, 159, 184, 194; 118/725, 729
See application file for complete search history.

(56) References Cited

U.S. PATENT DOCUMENTS 4,570,053 A * 2/1986 Ades et al. ..... 219/413
5,628,829 A * 5/1997 Foster et al. ..... 118/723 E
5,958,140 A * 9/1999 Arami et al. ..... 118/725
6,129,044 A * 10/2000 Zhao et al. ..... 118/715
6,171,982 B1 * 1/2001 Sato ..... 438/795
6,403,479 B1 * 6/2002 Watanabe et al. ..... 438/680
6,485,297 B2 * 11/2002 Nakamura ..... 432/242
6,488,986 B2 * 12/2002 Das et al. ..... 427/250
6,656,838 B2 * 12/2003 Watanabe et al. ..... 438/680
6,686,565 B2 * 2/2004 Lakra et al. ..... 219/388
6,706,325 B2 * 3/2004 Spitsberg et al. ..... 427/255.19
2002/0023946 A1 * 2/2002 Lakra et al. ..... 228/227

FOREIGN PATENT DOCUMENTS

JP 9-217122 8/1997
JP 2001-152294 T 11/2001
JP 2003027209 * 1/2003

* cited by examiner

*Primary Examiner*—Gregory A Wilson
(74) *Attorney, Agent, or Firm*—Bachman & LaPointe, P.C.

(57) ABSTRACT

A method for heat treating at least one workpiece, such as a coated turbine engine component, is provided. The method comprises the steps of cleaning a furnace to be used during the heat treating method, which cleaning method comprising injecting a gas at a workpiece center location and applying heat, and diffusion heat treating the at least one workpiece in a gas atmosphere with the gas being injected at the workpiece center location. After the diffusion heat treatment step, the coated workpiece(s) may be subjected to a surface finishing operation such as a peening operation.

8 Claims, 3 Drawing Sheets

CLEAN ATMOSPHERE HEAT TREAT FOR COATED TURBINE COMPONENTS

CROSS-REFERENCE TO RELATED APPLICATION(S)

This application is a divisional application of U.S. patent application Ser. No. 10/606,436, filed Jun. 25, 2003, entitled CLEAN ATMOSPHERE HEAT TREAT FOR COATED TURBINE COMPONENTS, By Steven M. Burns et al.

BACKGROUND OF THE INVENTION

The present invention relates to a method for heat treating workpieces, such as coated turbine components, and to an improved system for performing the heat treat method of the present invention.

Overlay type metallic coatings (i.e. NiCoCrAlY, CoCrAlY, etc.) are mostly characterized by their oxidation resistant sub-alloy protection properties and improved life span within the turbine engine environment. These overlay metallic coatings may be applied to substrate surfaces by thermal spray processes, such as low pressure plasma spray and atmosphere pressure plasma spray, or by vapor deposition processes such as electron beam physical vapor deposition or cathodic arc. The density of the coating plays an important role in the oxidation resistance characteristics as well as the life span at which the coating will protect the substrate from the corrosive environment in which it operates. A coating free of open pockets, voids, fissures, cracks, or leaders provides significantly longer oxidation life protection than a coating containing such aforementioned characteristics. The state-of-the art technology used today to ensure that such coatings are close to 100% dense as possible is to apply the coating as dense as possible, then diffusion heat treat the coating, followed by subjecting the overlay coating to energy from processes such as peening. The peening process transfers enough kinetic energy at impact from the peen media velocity into the coating surface to increase the coating density by compaction and to improve the coating surface finish. The extent to which the peening process can improve the coating density and surface finish is related to the amount of kinetic energy that can be transferred from the peening media impact event onto and into the coating surface (often measured with almen strip intensity) in conjunction with the coating's ductility. It should be noted that to apply coatings which are excessively ductile will not provide the proper protection within the hot corrosive environments in which they operate. Also, if one applies a coating that is excessively hard, the coating will not react well to the peening process and will leave excessive porosity within the coating structure, ultimately resulting in a poor life oxidation resistance coating.

SUMMARY OF THE INVENTION

Accordingly, it is an object to provide an improved method for heat treating coated workpieces, such as coated turbine engine components.

It is a further object of the present invention to provide an improved system for heat treating at least one coated workpiece.

The foregoing objects are attained by the present invention.

In accordance with the present invention, a method for heat treating workpieces is provided. The method broadly comprises the steps of cleaning a furnace to be used during the heat treating method, the cleaning method comprising injecting an inert gas, such as argon, or a reducing gas, such as hydrogen, at a workpiece center location and applying heat, and thereafter diffusion heat treating the at least one coated workpiece in a gas atmosphere, such as an inert gas or a reducing gas atmosphere, with the gas again being injected at the workpiece center location. After the heat treatment, the coated workpiece may be subjected to a surface finishing operation.

Further, in accordance with the present invention, there is provided a system for heat treating a coated workpiece broadly comprising a furnace and means for injecting a gas into an interior of the furnace at a workpiece center location.

Other details of the clean atmosphere heat treat for coated turbine components, as well as other advantages and objects attendant thereto, are set forth in the following detailed description and the accompanying drawings wherein like reference numerals depict like elements.

DETAILED DESCRIPTION OF THE PREFERRED EMBODIMENT(S)

Overlay coatings are subjected to a diffusion heat treatment process followed by high energy impact events from processes such as peening to improve the coating density. The extent that a coating can be made 100% dense is related to the coating ductility as well as the surface finishing energy that can be obtained.

It has been found by the inventors that the cleanliness of the diffusion heat treatment environment plays a significant role in coating ductility and the coating's final quality acceptability. A coating that has extensive open pockets, voids, fissures, cracks or leaders and has been exposed to a typical heat treat furnace atmosphere (vacuum or inert gas) can result in a coating that is impossible to bring to an acceptable density and acceptable quality condition. The contamination that affects the coating quality occurs within the furnace, from vacuum leaks and/or contamination from various elements within the furnace itself.

Previous practice within the coating industry to correct a contaminated furnace has been to ensure the furnace is adequately free from vacuum leaks (a leak-up rate of 20 microns an hour or less) and perform a vacuum burn-out heat treat cycle a few hundred degrees higher than the highest temperature production heat treat cycle previously used within the furnace.

It has been found that in cases where a coating that has been applied at a less than optimum deposition angle or in cases of a normally deposited coating that has an abundance of extensive open pockets, voids, fissures, cracks, or leaders followed by a diffusion heat treat cycle in a standard, normally acceptable and high temperature thermally cycled furnace, the coating generally cannot be transformed by surface finishing processes to an acceptable density/quality level.

The solution to improving coatings so they can be better transformed by surface finishing processes to a desirable density/quality level/surface finish begins with cleaning a furnace to be used in the diffusion heat treatment using a high temperature burnout heat-treat cycle with a gas, such as inert gas, preferably argon, and/or a reducing gas, such as hydrogen, being injected at the center of the work piece location area at a partial pressure preferably of 0.8 Torr or greater. It has been found that this creates a significantly cleaner furnace than the standard burn-out heat treat cycle used throughout the industry.

Figure 1:
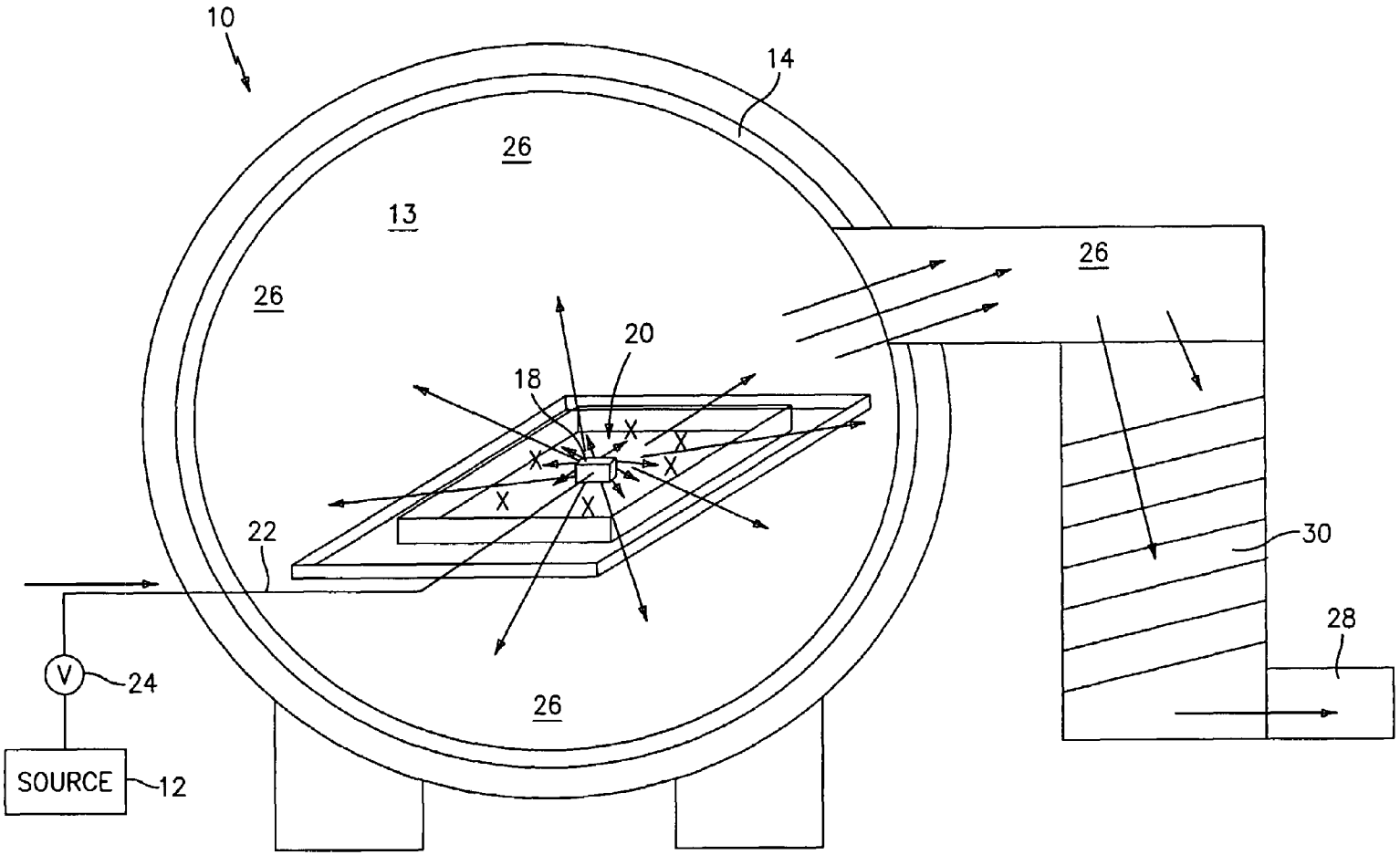
FIG. 1 is a schematic representative of a heat treatment system in accordance with the present invention.

FIG. 1 illustrates a modified heat treatment system 10 in accordance with the present invention. The system 10 includes a gas source 12, a furnace 13 having a chamber 14 in which workpieces (not shown), such as coated turbine engine components, to be treated are placed, a manifold 18 for delivering the gas to the center 20 of the work piece location area, a feed line 22 between the manifold 18 and the gas source 12, and a valve 24 for controlling the flow rate of the gas. The inventive furnace 13 is different from prior art furnaces where a gas is injected into the furnace through nozzles positioned about the exterior surface of the chamber 14. It has been found that nozzles positioned in such locations actually increase the contamination which appears in the workpieces and the coatings. This is because when heat treating a workpiece and coating within such a furnace, any contaminants which are present on or in the furnace walls are mostly turned into a vapor state once the furnace reaches adequate temperature. These contaminants are deposited onto the workpieces and the coating, changing the coating ductility by tying up grain boundaries within the coating. Once the ductility of the coating is decreased, the coating and workpiece cannot be surface finished with enough energy to adequately improve coating density to an acceptable level without damaging the work piece. It should be understood that when heat treating a coating within a furnace, any vacuum leaks which are present within the furnace leak in air which contains oxygen. The oxygen often oxidizes the workpieces as well as contaminates them, which changes the coating ductility by tying up grain boundaries within the coating. Once the ductility of the coating is decreased, the coating and the workpieces cannot be surface finished with enough energy to adequately improve coating density to an acceptable level without damaging the workpieces.

The system 10 of the present invention with the improved furnace design avoids such contamination of the workpieces and the coatings.

In accordance with the present invention, the furnace chamber 14 is first cleaned by heating the furnace to a temperature which is 200-300° F. greater than the diffusion heat treatment temperature, typically greater than 2000° F., for a time period of 30 minutes or more. During the heating cycle, the gas is introduced at a flow rate which creates movement of contaminants from the center 20 of the workpiece location towards low pressure areas 26 about the furnace chamber 14 created by one or more vacuum pumps 30 and the exit area 28. Suitable gas flow rates are within the range of those sufficient to carry the contaminants away from the center 20 to those which would cause the door of the furnace chamber 14 to open. A preferred flow rate for the gas is in the range of 30 liters per minute to 70 liters per minute. The gas is introduced at a partial pressure sufficient to create a pressure differential which carries the contaminants away from the center 20. A particularly useful gas partial pressure is 0.8 Torr or greater.

After cleaning the furnace in the above manner, the diffusion heat treatment of the coated workpieces is carried out in the same gas environment under the same gas flow rate and partial pressure conditions. As before, an inert gas, with argon being a preferred gas, and/or a reducing gas, such as hydrogen, is injected into the chamber 14 at the center 20 of the workpiece location at the flow rate and partial pressures mentioned hereinabove. It has been found that by flowing the gas at a rate of 30 liters per minute to 70 liters per minute, the vacuum level during the diffusion heat treatment is in the range of 800 microns to 2000 microns. While partial pressures of 0.8 Torr or greater are useful, the beneficial range of partial pressure depends on the configuration of the heat treat furnace as well as the quantity and condition of the coated workpieces being heat treated. The diffusion heat treatment may be carried out at a temperature in the range of 1900 degrees Fahrenheit to 2500 degrees Fahrenheit for a time period in the range of 1 to 24 hours. It has been found that workpieces subjected to the diffusion heat treatment described herein were able to be surface finished to produce an acceptable density and quality part.

After the diffusion heat treatment step, the workpieces with the coatings can be subjected to any surface finishing operation known in the art, such as a peening operation, to form a coating having an acceptable coating density and quality level.

The physics of producing an acceptable coating density and quality level through heat treating and surface finishing using the method of the present invention is as follows. When heat treating a workpiece and coating within a furnace, any vacuum leaks or elemental contamination which are present during the heat treat process will effectually reach the parts resulting in a decrease in coating ductility which cannot be further surface finished adequately to produce an acceptable density level coating. The method of first cleaning the furnace by performing a partial pressure heat treat with the gas, preferably argon, injected at the workpiece center location (typically the furnace center) results in the gas sweeping from the center of the furnace outward carrying (by means of random molecule collisions) all contaminates away from the furnace center which are removed by the vacuum pump(s) 30. The second step of actually performing the diffusion heat treatment of the coating and workpieces within the partial pressure gas atmosphere with the gas, preferably argon, being injected at the work pieces' center location results in a high pressure clean area within the vacuum furnace where the parts are located. All contaminates, whether from inside the furnace or as a result of vacuum leaks, are forced away from the high-pressure protective area (where the parts are located) by means of random molecule collisions where the high pressure area always seeks low pressure areas. This method results in a clean diffusion heat treatment that allows the coatings to adequately diffuse into the base alloy without changing the coating ductility.

The method of the present invention has been found to have particular utility in the diffusion heat treatment of turbine engine components having an overlay coating applied thereto. The method of the present invention can be used with any workpiece coated with any overlay coating known in the art.

Figure 2:
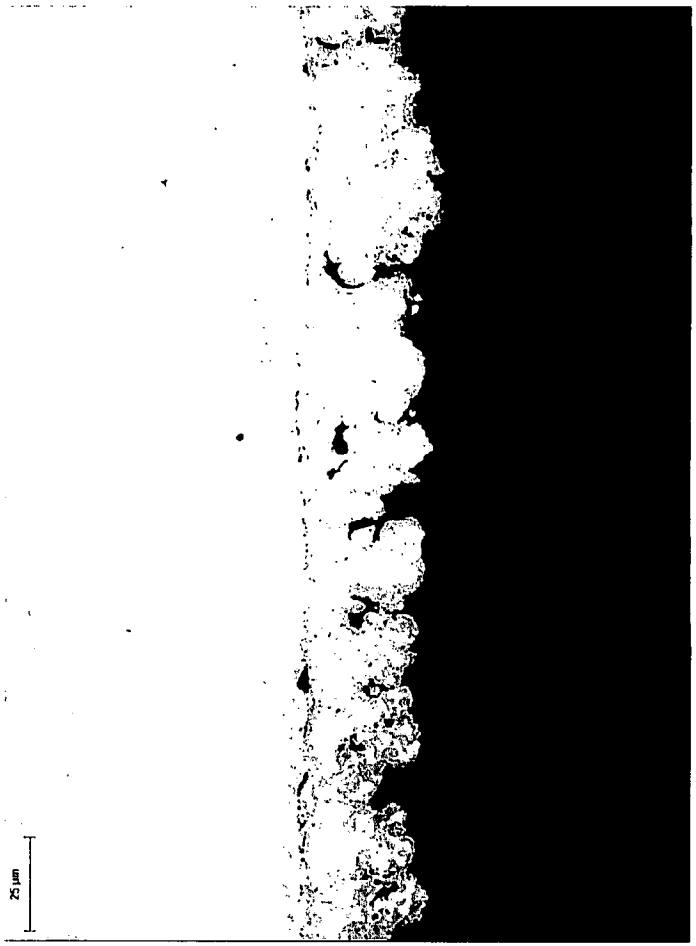
FIG. 2 is a photomicrograph showing an as deposited and diffused coating on a workpiece.
Figure 3:
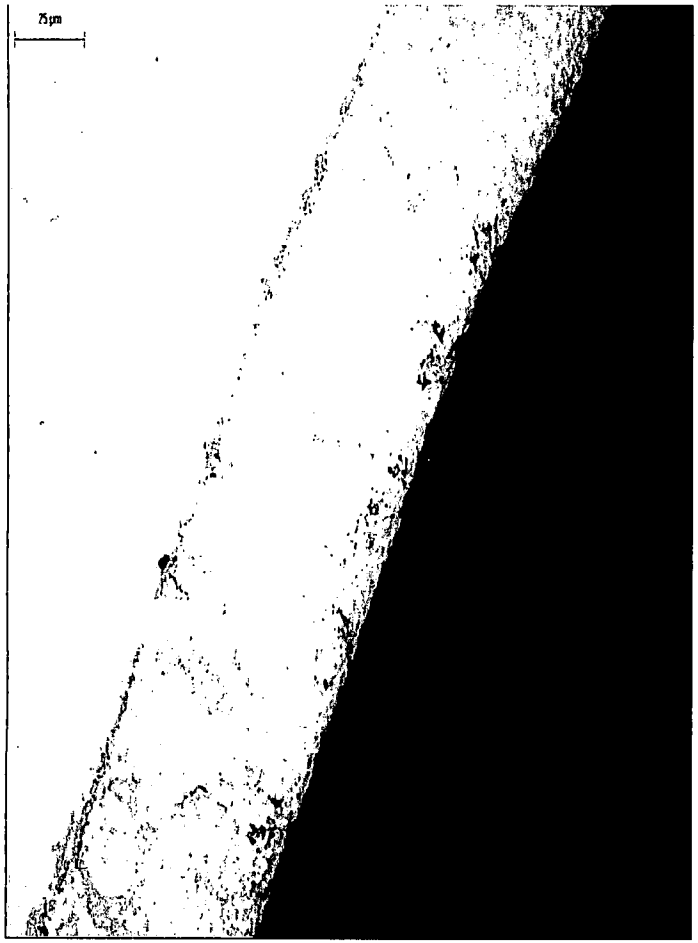
FIG. 3 is a photomicrograph showing a coating which has been subjected to the clean atmosphere diffusion heat treatment of the present invention after surface finishing.
Figure 4:
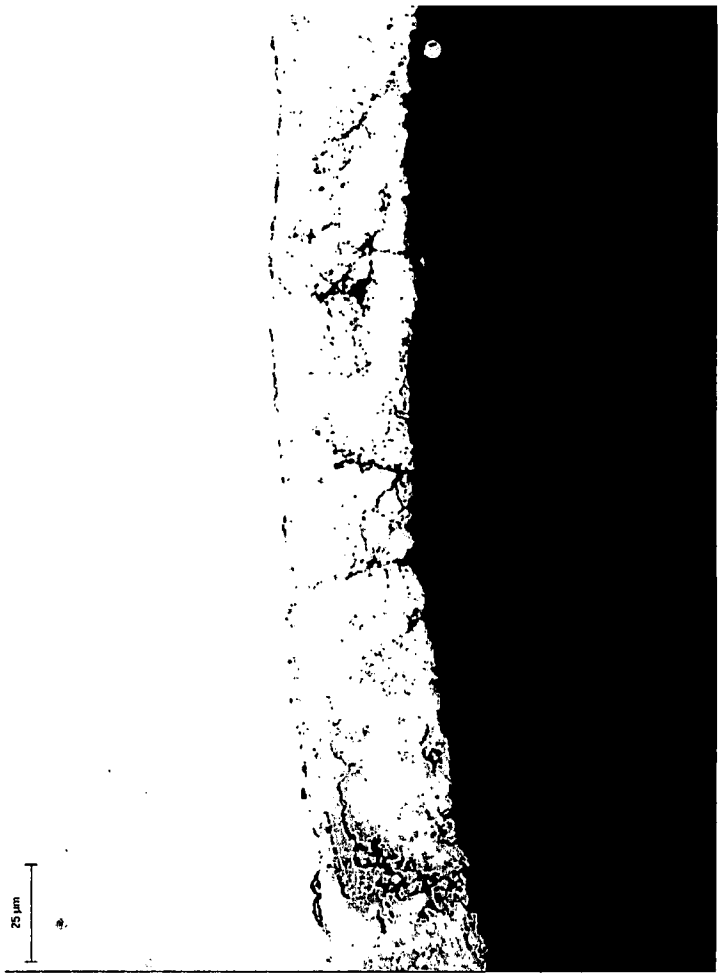
FIG. 4 is a photomicrograph showing a coating which has not been subjected to the clean atmosphere diffusion heat treatment of the present invention after surface finishing.

FIG. 2 illustrates a workpiece with an as deposited and diffused coating. FIG. 3 illustrates a coating which has been formed using the method described herein and which was surface finished by shot peening. As can be seen from FIG. 3, the coating is free of pores, voids, and other bad features. In fact, the coating is homogeneous and has very good ductility. FIG. 4 illustrates a coating which was not formed using the heat diffusion treatment of the present invention. After surface finishing, a poor quality coating was produced. As can be seen from FIG. 4, the coating has voids and fissures which makes it quite brittle.

While it is preferred to use a single gas for the furnace cleaning and diffusion heat treating steps, it is possible to use a mixture of gases, such as a mixture of inert gases or a mixture of an inert gas with a reducing gas.

It is apparent that there has been provided in accordance with the present invention a clean heat treat for coated turbine components which fully satisfies the objects, means, and advantages set forth hereinbefore. While the present invention has been described in the context of specific embodiments thereof, other alternatives, modifications, and variations will become apparent to those skilled in the art having read the foregoing detailed description. Accordingly, it is intended to embrace those alternatives, modifications, and variations as fall within the broad scope of the appended claims.

What is claimed is:

1. A system for heat treating a coated turbine engine component comprising:

a furnace having a chamber;

said coated turbine engine component being positioned within said chamber at a desired location, a gas source external to said chamber;

means for injecting a gas into an interior of said furnace chamber to said center of said coated turbine engine component location, said gas injecting means comprising a manifold connected to said gas source;

said manifold being positioned at said center of said coated turbine engine component location; and at least one vacuum pump external to said furnace chamber for creating at least one low pressure area in the furnace chamber and an exit area remote from said manifold and said gas being introduced into said chamber at a flow rate sufficient to carry contaminants away from the center of the coated turbine engine component location and less than the flow rate which would cause a door of the furnace chamber to open.

2. A system according to claim 1, wherein said injecting means comprises means for injecting at least one of an inert gas and a reducing gas.

3. A system according to claim 1, wherein said injecting means comprises means for injecting argon gas.

4. A system according to claim 1, further comprising a feed line between said manifold and said gas source and said feed line extending into said chamber.

5. A system according to claim 4, further comprising a valve between said gas source and said manifold for controlling a flow rate of said gas.

6. A system according to claim 1, wherein said gas injecting means does not include any nozzle positioned about an exterior surface of the chamber.

7. A system according to claim 1, wherein said gas is introduced at a flow rate in the range of from 30 liters per minute to 70 liters per minute and at a partial pressure of at least 0.8 Torr.

8. A system according to claim 1, wherein said center of the coated turbine engine component location is at a center of the furnace.

* * * * *